US008833265B2

(12) United States Patent
Uzkan

(10) Patent No.: US 8,833,265 B2
(45) Date of Patent: Sep. 16, 2014

(54) POWER CONTROL SYSTEM FOR A LOCOMOTIVE CONSIST

(75) Inventor: Teoman Uzkan, Indian Head Park, IL (US)

(73) Assignee: Electro-Motive Diesel, Inc., LeGrange, IL (US)

( * ) Notice: Subject to any disclaimer, the term of this patent is extended or adjusted under 35 U.S.C. 154(b) by 198 days.

(21) Appl. No.: 13/399,466

(22) Filed: Feb. 17, 2012

(65) Prior Publication Data

US 2013/0001370 A1 Jan. 3, 2013

Related U.S. Application Data

(60) Provisional application No. 61/502,587, filed on Jun. 29, 2011.

(51) Int. Cl.
*B61C 3/00* (2006.01)
*B61C 17/12* (2006.01)

(52) U.S. Cl.
CPC ..... *B61C 17/12* (2013.01)
USPC ..... 105/61; 246/167 R; 246/122 R

(58) Field of Classification Search
USPC ..... 246/167 R, 122 R; 105/61, 49, 50, 51, 105/61.5, 62.1, 62.2
See application file for complete search history.

(56) References Cited

U.S. PATENT DOCUMENTS

| | | | | |
|---|---|---|---|---|
| 4,037,526 | A * | 7/1977 | Jaekle | 454/166 |
| 4,698,761 | A * | 10/1987 | Cooper et al. | 701/19 |
| 5,392,741 | A * | 2/1995 | Uzkan | 123/41.13 |
| 5,425,338 | A * | 6/1995 | Gottemoller | 123/358 |
| 5,561,602 | A * | 10/1996 | Bessler et al. | 701/1 |
| 6,263,505 | B1 * | 7/2001 | Walker et al. | 725/110 |
| 7,072,747 | B2 * | 7/2006 | Armbruster et al. | 701/19 |
| 2004/0044447 | A1 * | 3/2004 | Smith | 701/19 |
| 2005/0109882 | A1 * | 5/2005 | Armbruster et al. | 246/167 R |
| 2013/0001370 | A1 * | 1/2013 | Uzkan | 246/186 |

FOREIGN PATENT DOCUMENTS

FR 1546969 11/1968

* cited by examiner

*Primary Examiner* — Jason C Smith
(74) *Attorney, Agent, or Firm* — Finnegan, Henderson, Farabow, Garrett & Dunner LLP

(57) ABSTRACT

The present disclosure is directed to a power control system for a consist. The consist may include a plurality of locomotives, each locomotive having an engine. The power control system may include a plurality of locomotive controllers. Each locomotive controller may be associated with one of the engines and configured to monitor temperature and power conditions of the associated engine. The power control system may also include a central controller adapted to receive temperature and power conditions from each locomotive controller and to determine desired power levels for each engine in the consist based on the received temperature and power conditions of the plurality of locomotives.

21 Claims, 5 Drawing Sheets

POWER CONTROL SYSTEM FOR A LOCOMOTIVE CONSIST

This application claims the benefit of priority under 35 U.S.C. §119(e) of U.S. Provisional Application No. 61/502,587, filed Jun. 29, 2011, the disclosure of which is incorporated herein by reference.

TECHNICAL FIELD

The present disclosure relates generally to operation of a consist and, more particularly, to systems and methods for controlling the total train power of a consist in tunnel passing.

BACKGROUND

In traditional consist arrangements, the cooling systems and power controls of each locomotive may be controlled separately. In such arrangements, there is no information exchange, communications link, or control coordination among the locomotives' cooling systems or power controls. As a result, each locomotive's control system is required to derate its respective engine when the engine coolant temperature exceeds the allowable maximum of that particular locomotive and its cooling system is operating at full capacity. However, the cooling air inlet temperatures of each locomotive in the consist are interrelated, especially in tunnel conditions.

When a consist passes through a tunnel, each locomotive transfers heat from the engine to the surrounding ambient air, which is then trapped inside the tunnel until the consist passes through. As a result, a trailing locomotive's cooling system receives air that has been increasingly heated by each locomotive preceding it into the tunnel. This may cause engine coolant temperatures to be increased above permissible limits, requiring power derating of the trailing locomotives. In prior art systems, derating is performed on each locomotive based solely on its own environmental and engine conditions. This power control reduction occurs without reference to or consideration of the power levels of the other locomotives in the consist. As a result, the total train power of the consist may be lower than necessary, especially for locomotive operation in tunnel conditions.

One solution for maintaining locomotive operation in tunnel conditions is described in U.S. Pat. No. 7,072,747 B2 ("the '747 patent"). The '747 patent is directed to a method of controlling passage of a consist through a tunnel that purportedly maintains a sufficient combined performance capability from the locomotives to move the consist through the tunnel.

The solution provided by the '747 patent requires that the locomotives are each configured, prior to the consist entering the tunnel, for passage through the tunnel. This requires advanced configuration of the consist based on the tractive effort required to move the consist through the tunnel and the relative location of each locomotive within the consist. Additionally, this requires anticipation of the characteristics of each tunnel the consist will pass through. The solution provided by the '747 patent is unable to operate unless it receives location data related to both the tunnel and the relative location of each locomotive in the consist. Once the consist is traveling through the tunnel, the method disclosed in the '747 patent purportedly is able to dynamically change which of the locomotives is idling to maintain a sufficient total train effort. However, the method of the '747 patent is unable to control the cooling systems of each of the locomotives, nor does it disclose dynamic derating of the locomotives. Rather, the disclosed control is limited to switching the mode of a locomotive between idling and full tractive power.

The presently disclosed power control system is directed to overcoming one or more of the problems set forth above and/or other problems in the art.

SUMMARY OF THE INVENTION

In accordance with one aspect, the present disclosure is directed to a power control system for a consist. The consist may include a plurality of locomotives, each locomotive having an engine. The power control system may include a plurality of locomotive controllers. Each locomotive controller may be associated with one of the engines and configured to monitor temperature and power conditions of the associated engine. The power control system may also include a central controller adapted to receive temperature and power conditions from each locomotive controller and to determine desired power levels for each engine in the consist based on the received temperature and power conditions of the plurality of locomotives.

According to another aspect, the present disclosure is directed to a method for controlling the total train power of a consist. The consist may include a plurality of locomotives, each locomotive having an engine. The method may include receiving at a central location power conditions and temperature data from each of the locomotives. The method may also include determining desired power levels for each of the engines and adjustments for at least one engine to achieve the desired power levels based on the conditions and temperature data received from each of the locomotives. The method may also include communicating the respective adjustments for at least one engine to the respective locomotive.

In accordance with another aspect, the present disclosure is directed to a consist. The consist may also include a plurality of locomotives. Each locomotive may include an engine. Each locomotive may include a cooling system adapted to regulate a temperature of the engine. Each locomotive may include a locomotive controller configured to monitor and control the engine and the cooling system. Each locomotive may also include an engine temperature sensor configured to determine the engine temperature and to send a signal to the locomotive controller indicative of the engine temperature. Each locomotive may further include an air temperature sensor configured to determine ambient air temperature and to send a signal to the locomotive controller indicative of the ambient air temperature. The consist may include a central controller configured to receive the engine temperatures and ambient air temperatures from each of the locomotive controllers and to determine desired power levels for each engine in the consist based on the received temperature and power conditions of the plurality of locomotives.

DETAILED DESCRIPTION

Figure 1:
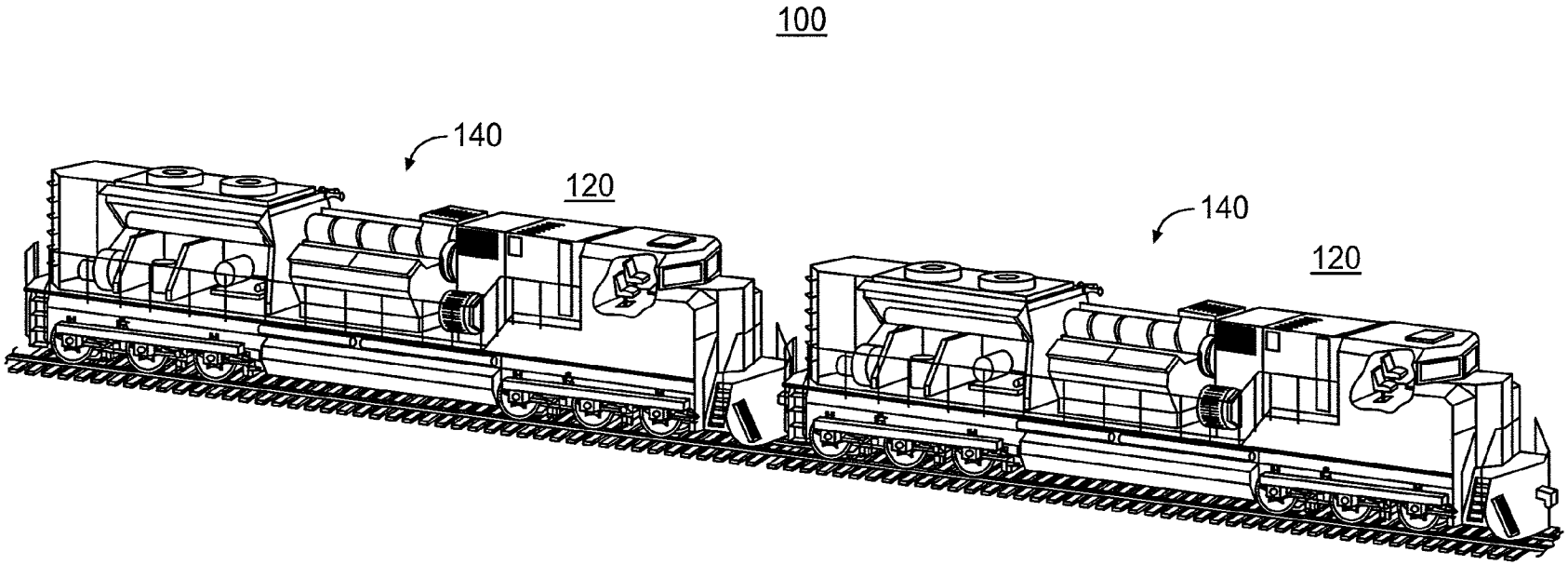
FIG. 1 illustrates pictorial view of an exemplary consist.

FIG. 1 illustrates a consist 100 comprising a plurality of locomotives 120, the plurality including at least a first and a last locomotive 120. Each locomotive 120 may include an engine 140. In one embodiment, engine 140 may comprise a uniflow two-stroke diesel engine system. While not shown in FIG. 1, consist 100 may comprise more than two locomotives 120. Additionally, consist 100 may also comprise a variety of other railroad cars, such as freight cars or passenger cars, and may employ different arrangements of the cars and locomotives to suit the particular use of consist 100.

Figure 2:
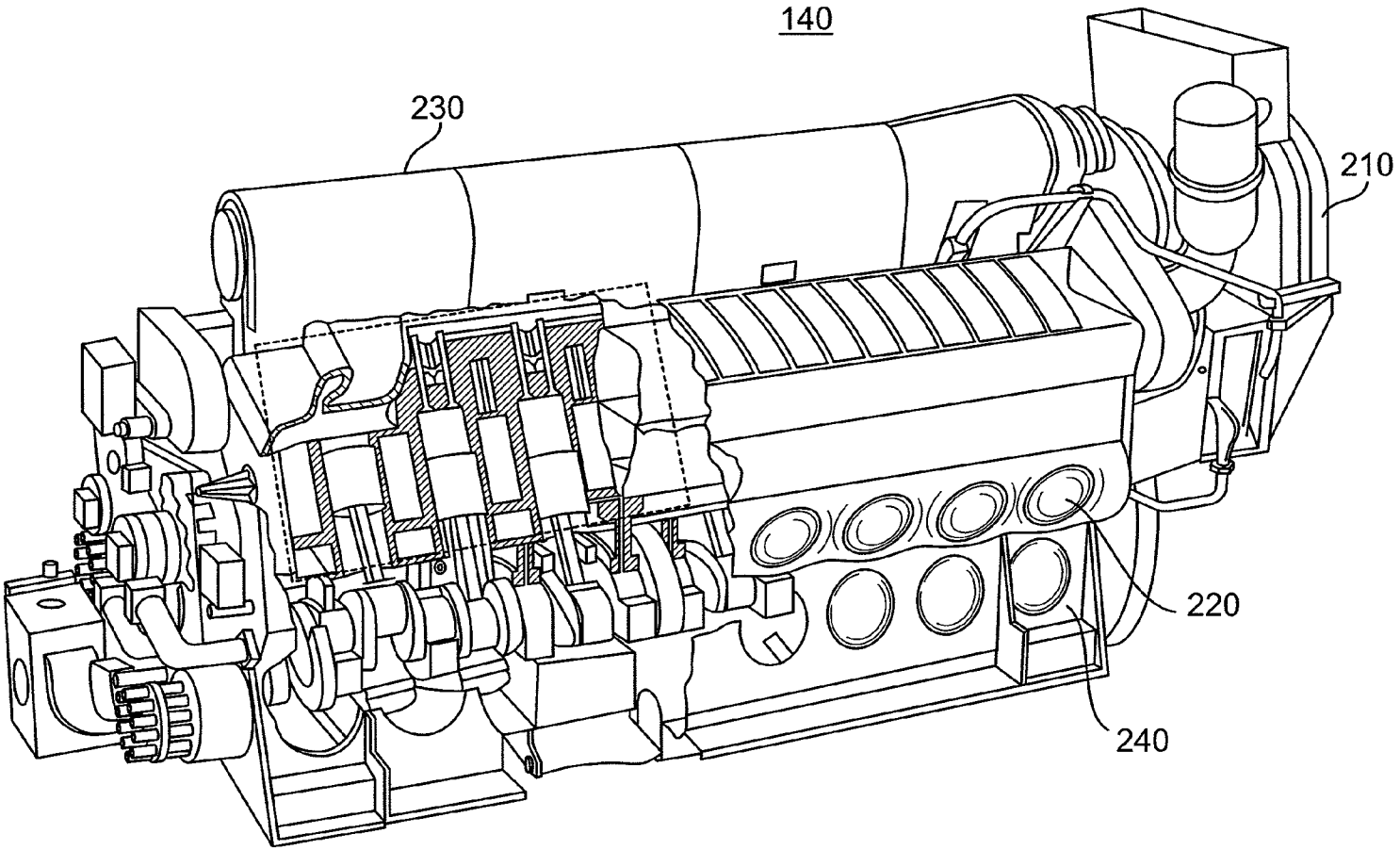
FIG. 2 illustrates pictorial perspective view of an engine.

FIG. 2 illustrates an exemplary engine 140, which may include a conventional air system. For example, engine 140 may comprise a turbocharger 210 having a compressor and a turbine. In addition to turbocharger 210, engine 140 may also comprise an airbox 220, an exhaust manifold 230, and a crankcase 240 for combustion. Turbocharger 210 may provide compressed air to engine 140. The compressor of turbocharger 210 may transfer compressed ambient air to an aftercooler 250 where the compressed air is cooled to a select temperature. Environmental, economic, and safety considerations impose restrictions on the maximum operating temperature of engine 140 in order to improve engine emissions and sustain the operating life of the engine. Therefore, engine 140 may have a predetermined engine temperature threshold, for example, a predetermined engine coolant temperature threshold. The cooling of compressed air in aftercooler 250 may decrease engine fuel consumption and NOx emissions.

Figure 3:
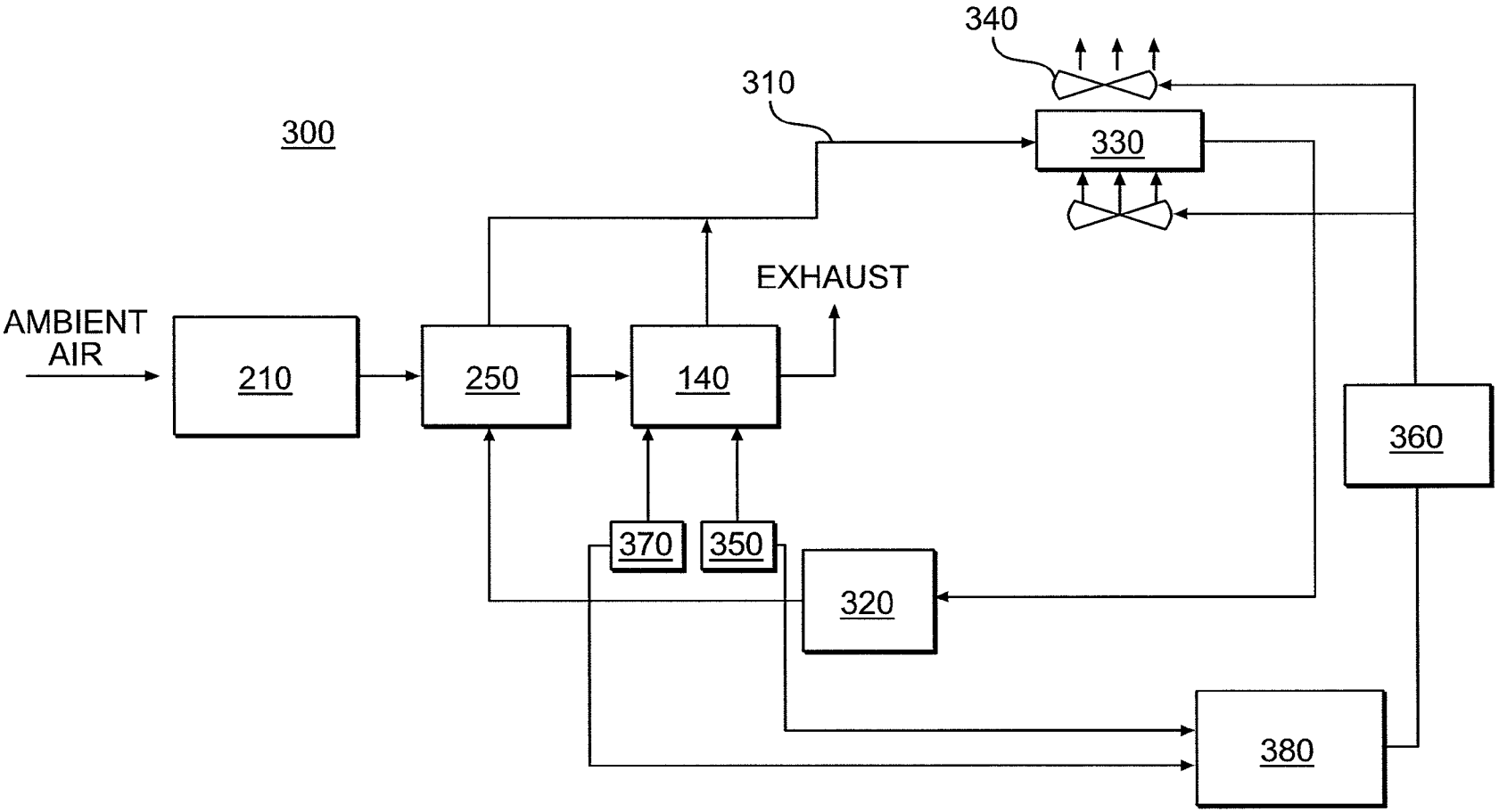
FIG. 3 provides a block diagram of an exemplary cooling system for an engine.

FIG. 3 shows a diagram of a cooling system 300 designed to maintain engine temperature below the predetermined engine temperature threshold. Cooling system 300 may be adapted to regulate the temperature of engine 140. In one embodiment, cooling system 300 may use a coolant, such as water, to cool engine 140. In another embodiment, cooling system 300 may use an antifreeze solution as a coolant. Cooling system 300 may have certain limitations to keep the coolant temperature below a maximum engine coolant temperature limit. In cooling systems that use water as a coolant, the coolant temperature limit may be 212° F., the boiling temperature of water at standard ambient air pressure. The maximum engine coolant temperature limit may be chosen to ensure cooling system 300 continues to function to cool engine 140.

Cooling system 300 may comprise a water loop 310 through which coolant may flow. In one embodiment, the heat generated by engine 140 may be transferred to the coolant circulating through water loop 310. A water pump 320 may provide circulation of water or other coolant from engine 140, through water loop 310. Once the coolant has flowed through water loop 310, it may reach radiator 330. Radiator 330 may include one or more fans 340 for driving ambient air through radiator 330 to cool the water in water loop 310 and transfer heat to the ambient air. The cooled water may then circulate to other components and back to engine 140.

Locomotive 120 may maintain the engine coolant temperature within a desired operational range by controlling various cooling system 300 components. In one embodiment, the desired operational coolant temperature range for engine 140 may be between 170° F. and 180° F. Cooling system 300 may include sensors for ensuring the engine coolant temperature stays within a desired range. An engine temperature sensor 350 may determine and communicate a coolant temperature associated with engine 140 to a locomotive controller 380. When the upper or lower temperature limit is reached, locomotive controller 380 may command a fan speed actuator 360 to change the speed of fans 340 to adjust the coolant temperature.

When the ambient air temperature increases, the temperature of the coolant in cooling system 300 also increases as a result of the decreased ability of fans 340 to draw as much heat away from the coolant in radiator 330. This reduces the capacity of cooling system 300. Specifically, when the ambient air temperature and engine load reach a certain threshold, the cooling capacity of cooling system 300 may not be sufficient to maintain coolant temperatures within the desired limits, even when operating at full cooling capacity of fans 340. Cooling system 300 may also include an air temperature sensor 370 for monitoring the temperature of the ambient air around engine 140.

Locomotive controller 380 may be provided for monitoring and controlling engine 140. In one embodiment, locomotive controller 380 may receive temperature data from one or more sensors. For example, locomotive controller 380 may receive ambient air temperature data from air temperature sensor 370. Locomotive controller 380 may be configured to ensure the coolant temperature of engine 140 does not exceed the predetermined engine coolant temperature threshold. Alternatively or additionally, locomotive controller 380 may receive engine coolant temperature data from engine temperature sensor 350. Locomotive controller 380 may also monitor other power conditions of locomotive 120. In one embodiment, this may include monitoring the fueling rate of engine 140. In one embodiment, locomotive controller 380 may command fan speed actuator 360 to change the speed of fans 340 in response to a change in engine coolant temperature. Locomotive controller 380 may adjust a parameter associated with engine 140. In one embodiment, the parameter associated with engine 140 may include the fueling rate and/or the fan speed.

Locomotive controller 380 may embody a single microprocessor or multiple microprocessors that include a means for receiving temperature data from engine temperature sensor 350 and air temperature sensor 370. Numerous commercially available microprocessors can be configured to perform the functions of locomotive controller 380. It should be appreciated that locomotive controller 380 could readily embody a general machine or engine microprocessor capable of controlling numerous machine or engine functions. Locomotive controller 380 may include all the components required to run an application such as, for example, a memory, a secondary storage device, and a processor, such as a central processing unit or any other means known. Various other known circuits may be associated with locomotive controller 380, including power source circuitry (not shown), gate driver circuitry, and other appropriate circuitry.

When cooling system 300 is operating at maximum cooling capacity and is unable to keep the coolant temperature below the coolant temperature limit, it may be necessary to decrease the heat generated by engine 140. In one embodiment, decreasing the heat generated by engine 140 may include reducing engine power, or engine derating. In one embodiment, reducing the fuel supply to the engine by lowering the fueling rate may decrease the heat generated by engine 140. Locomotive controller 380 may control the fueling rate of engine 140 to derate locomotive 120.

Figure 4:
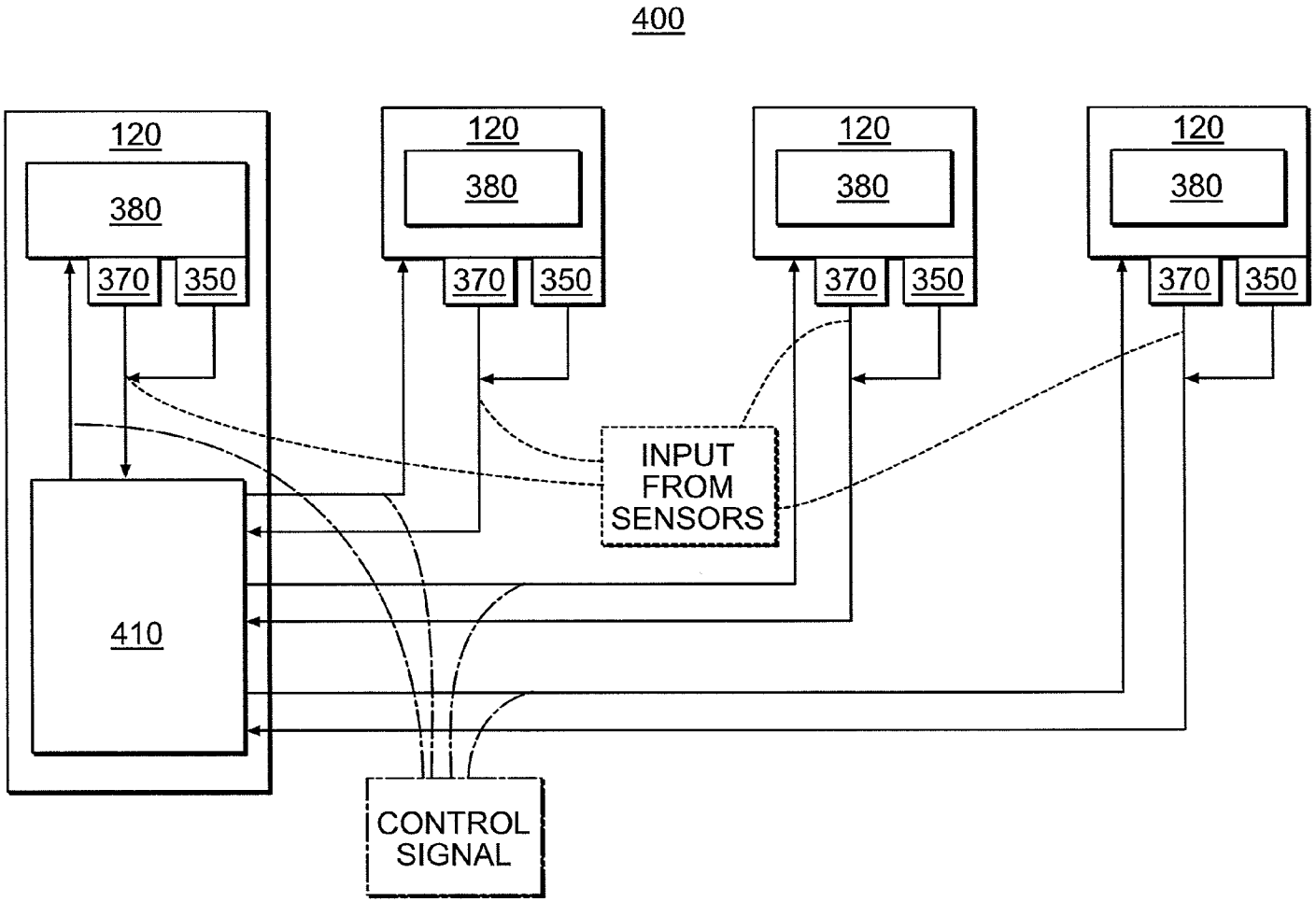
FIG. 4 illustrates a block diagram of an exemplary power control system for a consist.

FIG. 4 illustrates a block diagram of an exemplary power control system 400 for consist 100. The exemplary power control system 400 is configured to control the power of consist 100 containing four locomotives 120. However, other configurations of power control system 400 capable of handling a consist with fewer or more locomotives 120 will be apparent to those skilled in the art. Power control system 400 may indirectly or directly monitor the temperature and fueling characteristics of each locomotive 120 in consist 100 to control the total train power. Power control system 400 may comprise one locomotive controller 380 for each locomotive 120 and a central controller 410 to monitor the operations of consist 100 as a whole.

As discussed with reference to FIG. 3, each locomotive 120 may include locomotive controller 380 and sensors 350, 370 to monitor and control its respective engine 140. Power control system 400 may use these components to monitor each locomotive 120. Furthermore, each locomotive controller 380 may be adapted to control the power conditions of its respective locomotive 120. Locomotive controller 380 may be adapted to communicate with central controller 410. For example, locomotive controller 380 may send temperature and power conditions to central controller 410. In one embodiment, locomotive controller 380 may be configured to receive and execute commands regarding desired power levels from central controller 410. For example, central controller 410 may command locomotive controller 380 to change the fueling rate of locomotive 100.

Central controller 410 may be adapted to receive temperature and power conditions of engines 140 from each locomotive controller 380. As shown in FIG. 4, central controller 410 may be located on one locomotive 120 in consist 100. Alternatively, central controller 410 may be located on another car, such as a tender car, in consist 100 or in a remote location. In one embodiment, central controller 410 may fulfill the role of locomotive controller for one locomotive 120, in addition to communicating with the other locomotive controllers 380 in consist 100. With the data received from each locomotive controller 380, central controller 410 may determine the desired power levels for each engine 140 to control the total train power of consist 100 without exceeding the engine coolant temperature threshold of each locomotive 120.

Central controller 410 may be configured to communicate commands to each locomotive controller 380 to configure the respective engines 140 to the desired power levels. These commands may include adjusting cooling system 300 associated with each locomotive 120 to achieve the desired power levels. In one embodiment, central controller 410 may control locomotive controller 380 to maintain the coolant temperature within a desired operational range. Central controller 410 may be configured to communicate commands regarding the power conditions of the respective engines 140. For example, the power conditions may include changing the fueling rate of the respective engines 140.

Central controller 410 may embody a single microprocessor or multiple microprocessors that include a means for communicating with each locomotive controller 380. Numerous commercially available microprocessors can be configured to perform the functions of central controller 410. It should be appreciated that central controller 410 could readily embody a general machine or engine microprocessor capable of controlling numerous machine or engine functions. Central controller 410 may include all the components required to run an application such as, for example, a memory, a secondary storage device, and a processor, such as a central processing unit or any other means known. Various other known circuits may be associated with central controller 410, including power source circuitry (not shown), gate driver circuitry, and other appropriate circuitry.

Power control system 400 may include one or more engine temperature sensors 350 to measure the coolant temperature associated with a respective engine 140. Power control system may also comprise one or more air temperature sensors 370 to measure the temperature of the ambient air around a respective engine 140. Sensors 350, 370 may relay the respective data as values to the respective locomotive controller 380. In turn, each locomotive controller 380 may relay this data to central controller 410. If the coolant temperature of one of the engines 140 in consist 100 reaches the upper or lower temperature limit, central controller 410, via locomotive controller 380, may command fan speed actuator 360 to change the speed of fans 340 and/or turn fans 340 on or off to adjust the coolant temperature of each engine 140 in consist 100.

However, before ordering the change of fan speed of any individual engine 140, central controller 410 may calculate power levels and temperatures associated with each engine 140. The calculation of central controller 410 may be made through a predefined model. For example, calculations may be made based on a train operation model, an empirical procedure, a multi-locomotive feedback loop, or a detailed predictive model. If the model is simple and the characteristics of engine 140 and environmental conditions are not known, power control system 400 may calculate the power distribution in smaller time intervals and the control type may be a continuous feedback control system. If the characteristics of engines 140 and environmental conditions are known in detail, and the model is well developed and adjusted, then a simpler power control system 400 operating in larger time intervals may be utilized. Models representing characteristics of engines 140 are well known in the art.

Central controller 410 may operate to control and monitor consist 100 as a whole. In one embodiment, central controller 410 may communicate with each locomotive controller 380. Central controller 410 may be provided with information regarding each engine 140 and cooling system 300. Central controller 410 may be configured to send commands to each locomotive controller 380 to adjust its respective fueling rate and/or change the speed of fans 340 of cooling system 300 to achieve the calculated train power levels without exceeding the engine coolant temperature threshold of each locomotive 120. For example, central controller 410 may order power reduction starting from first locomotive 120 toward the last to control the total train power. In one embodiment, central controller 410 may send commands to each locomotive controller 380 to shut down its respective engine 140, starting with engine 140 associated with first locomotive 120 and ending with engine 140 associated with last locomotive 120.

Figure 5:
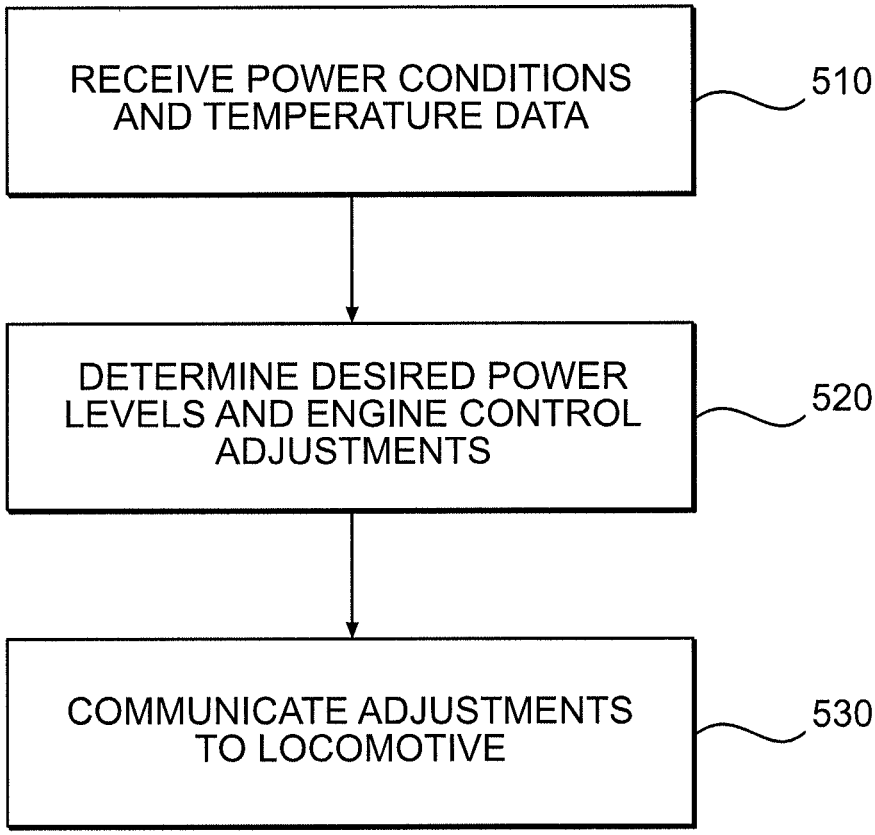
FIG. 5 provides a flowchart depicting an exemplary method for controlling the total power of a consist.

FIG. 5 illustrates a method for controlling the total train power of consist 100. The method may include monitoring and controlling locomotives 120 collectively, rather than individually. This may include derating each locomotive 120 in consist 100, including first locomotive 120, as necessary to benefit consist 100 as a whole.

The method may include receiving at a central location power conditions and temperature data from each locomotive 120 (Step 510). This may include receiving temperature data relating to the engine coolant temperature. Additionally or alternatively, the temperature data may also include data relating to the ambient air temperature associated with each engine 140. In one embodiment, power conditions may include the fueling rate associated with each engine 140. Additionally or alternatively, power conditions may include data relating to the capacity of cooling system 300, such as the speed of fans 340.

The temperature data may be received directly from engine temperature sensor 350 and air temperature sensor 370. Alternatively or additionally, this data may be received from locomotive controller 380 associated with each locomotive 120. In one embodiment, power conditions may be received from each locomotive controller 380. For example, power conditions may comprise the fueling rate of each engine 140.

This method may also include determining desired power levels for each of the engines 140 and adjustments for at least one engine 140 to reach the desired power levels (Step 520).

Determining desired power levels may include calculations based on the data received in Step 510. These desired power levels may also be based on known characteristics of each engine 140. Determining desired power levels for each engine 140 may include ensuring the power level of each locomotive 120 does not cause the engine coolant temperature threshold of any of locomotives 120 in consist 100 to be exceeded. In one embodiment, this step may comprise using a predefined model to control total train power of consist 100.

These adjustments may be made such that each engine 140 does not exceed its engine coolant temperature threshold. In one embodiment, the adjustments for at least one engine 140 may comprise modifying the fueling rate. Additionally or alternatively, adjustments for at least one engine 140 may include adjustments to cooling system 300 associated with each engine 140. For example, adjustments to the engine control may include changing the speed of fans 340.

Additionally, this method may include communicating the respective adjustments for at least one engine 140 to respective locomotive 120 (Step 530). In one embodiment, central controller 410 may communicate these control adjustments to each of the locomotive controllers 380 associated with each locomotive 120. Alternatively, central controller 410 may communicate adjustments to cooling system 300 directly to fans 340 through fan speed actuator 360, bypassing locomotive controller 380. In one embodiment, this step may include sending a signal to locomotive controller 380 to change the fueling rate of its respective locomotive 120.

In one embodiment, to overcome the air heating effects of first locomotive 120 on trailing locomotives 120, the method may include reducing the power levels of first locomotive 120 to maintain a higher cooling capacity in trailing locomotives 120. The position of derated locomotive 120, relative to other locomotives 120 in consist 100, may be crucial to increasing total power levels of consist 100 without exceeding the respective coolant temperature limits of each locomotive 120. In a tunnel environment, the position of derated locomotive 120 within consist 100 affects the inlet air temperature to cooling system 300 of each trailing locomotive 120. As shown below in Table, the position of derated locomotive 120 within consist 100 affects the inlet air temperature of cooling system 300 of each locomotive 120. In this example, derated locomotive 120 is operating at 3,000 brake horsepower ("bhp") and remaining locomotives 120 operate at 4,400 bhp. The total traction power of consist 100 is kept constant at 16200 bhp. The calculations below are for consists 100 entering a long tunnel at approximately 19 miles per hour ("mph").

TABLE

| | | | | | |
|---|---|---|---|---|---|
| CONSIST 1: | Locomotive # | 1 | 2 | 3 | 4 |
| | Power Level | 3,000 bhp | 4,400 bhp | 4,400 bhp | 4,400 bhp |
| | Cooling System Air Inlet Temp | 50° F. | 89° F. | 148.4° F. | 206.9° F. |
| CONSIST 2: | Locomotive # | 1 | 2 | 3 | 4 |
| | Power Level | 4,400 bhp | 3,000 bhp | 4,400 bhp | 4,400 bhp |
| | Cooling System Air Inlet Temp | 50° F. | 108.5° F. | 148.4° F. | 206.9° F. |
| CONSIST 3: | Locomotive # | 1 | 2 | 3 | 4 |
| | Power Level | 4,400 bhp | 4,400 bhp | 3,000 bhp | 4,400 bhp |
| | Cooling System Air Inlet Temp | 50° F. | 108.5° F. | 167° F. | 206.9° F. |

TABLE-continued

| | | | | | |
|---|---|---|---|---|---|
| CONSIST 4: | Locomotive # | 1 | 2 | 3 | 4 |
| | Power Level | 4,400 bhp | 4,400 bhp | 4,400 bhp | 3,000 bhp |
| | Cooling System Air Inlet Temp | 50° F. | 108.5° F. | 167° F. | 225.5° F. |

The position of derated locomotive 120, which gives the lowest inlet air temperatures to each trailing locomotive 120, may be critical. If first locomotive 120 is derated, the inlet air temperatures for all trailing locomotives 120 may be the lowest within this variation. When derated locomotive 120 is placed at any location other than last, the inlet air temperature of trailing locomotives 120 may be higher. The lowest inlet air temperatures may be possible if first locomotive 120 is derated first. Therefore, the location of derated locomotive 120 may be important in increasing the total train power. Furthermore, derating first locomotive 120 in consist 100 is more desirable than derating the last one, as it affects all of trailing locomotives 120.

INDUSTRIAL APPLICABILITY

The disclosed power control system and methods provide a robust solution for controlling the total train power of a consist, especially when traveling through tunnels and other enclosed spaces. The disclosed systems and methods are able to monitor and control the cooling systems and power controls of the consist as an entire system, rather than on an individual locomotive level. As a result, the total train power of the consist can be increased by decreasing the effects of engine exhaust heating of ambient air temperatures on trailing locomotives in the consist.

The presently disclosed consist may have several advantages. Specifically, the presently disclosed power control system can choose to derate the particular locomotive that will have the greatest effect on the train power of the consist. When the consist is traveling through a tunnel, the location of the derated locomotives is a key factor affecting the ambient air temperatures around each of the locomotives. The disclosed systems can dynamically choose which locomotives to derate based on various environmental and mechanical concerns.

Additionally, the disclosed systems are able to exercise precise control over the consist. For example, the disclosed system is able to control both the power levels and the cooling systems of each of the locomotives in the consist. Also, the disclosed system is able to alter the power levels more precisely than just idling each of the locomotives.

Furthermore, the disclosed solutions are able to dynamically adjust power levels without advanced warning of a tunnel condition. This is especially beneficial when the consist encounters an unexpected tunnel or location data of the consist and any tunnels is unavailable.

It will be apparent to those skilled in the art that various modifications and variations can be made to the disclosed power control system for a consist and associated methods for operating the same. Other embodiments of the present disclosure will be apparent to those skilled in the art from consideration of the specification and practice of the present disclosure. It is intended that the specification and examples be considered as exemplary only, with a true scope of the present disclosure being indicated by the following claims and their equivalents.

What is claimed is:

1. A power control system for a consist, the consist comprising a plurality of locomotives, each locomotive having an engine, said power control system comprising:

a plurality of locomotive controllers, each locomotive controller associated with one of the engines and configured to monitor temperature and power conditions of the associated engine; and a central controller programmed to:

receive temperature and power conditions from each locomotive controller;

determine desired power levels for each engine in the consist based on the received temperature and power conditions of the plurality of locomotives; and determine an adjustment to a cooling system associated with each engine to achieve the desired power levels without exceeding a predetermined engine temperature threshold of each of the locomotives.

2. The power control system of claim 1, wherein each locomotive controller is configured to ensure the temperature of the associated engine does not exceed the predetermined engine temperature threshold.

3. The power control system of claim 1, wherein the central controller comprises a locomotive controller associated with one of the engines in the consist.

4. The power control system of claim 1, wherein the central controller uses a predefined model to determine the desired power levels for each engine in the consist.

5. The power control system of claim 1, wherein the central controller is configured to communicate commands to each of the locomotive controllers to configure the respective engines to the desired power levels.

6. The power control system of claim 5, wherein the power conditions comprise a fueling rate.

7. The power control system of claim 6, wherein the central controller is configured to command each locomotive controller to adjust the cooling system associated with the respective engine to achieve the desired power levels without exceeding the predetermined engine temperature threshold of each of the locomotives.

8. A method for controlling the total power of a consist, the consist comprising a plurality of locomotives, each locomotive having an engine, the method comprising:

receiving at a central location power conditions and temperature data from each of the locomotives;

determining desired power levels for each of the engines and adjustments for at least one engine and at least one cooling system to achieve the desired power level based on the conditions and temperature data received from each of the locomotives; and communicating the respective adjustments for at least one engine to the respective locomotive.

9. The method of claim 8, wherein temperature data comprises an engine temperature of at least one of the engines and ambient air around at least one of the engines.

10. The method of claim 9, wherein determining desired power levels for each of the engines to control the total train power of the consist further includes ensuring the desired power level for each locomotive does not cause the engine temperature of at least one of the engines to exceed a predetermined engine temperature threshold of the respective locomotive.

11. The method of claim 8, wherein adjustments for at least one engine comprises modifying the fueling rate of at least one engine in the consist.

12. The method of claim 8, wherein adjustments for at least one engine comprises changing a fan speed associated with the at least one engine.

13. The method of claim 8, wherein determining desired power levels for each engine comprises using a predefined model to control the total train power of the consist.

14. A consist, comprising:

a plurality of locomotives, each locomotive comprising:

an engine;

a cooling system adapted to regulate a temperature of the engine;

a locomotive controller configured to monitor and control the engine and the cooling system;

an engine temperature sensor configured to determine the engine temperature and to send a signal to the locomotive controller indicative of the engine temperature; and an air temperature sensor configured to determine ambient air temperature and to send a signal to the locomotive controller indicative of the ambient air temperature; and a central controller programmed to:

receive the engine temperatures and ambient air temperatures from each of the locomotive controllers;

determine desired power levels for each engine in the consist based on the received engine and ambient air temperatures and power conditions of the plurality of locomotives; and determine an adjustment to the cooling system associated with each locomotive to achieve the desired power levels without exceeding a predetermined engine temperature threshold of each of the locomotives.

15. The consist of claim 14, wherein each locomotive controller is configured adjust a parameter associated with the engine.

16. The consist of claim 15, wherein the parameter is at least one of a fueling rate and a fan speed.

17. The consist of claim 14, wherein the central controller is configured to:

determine desired power levels for each engine to control the total train power of the consist without exceeding a predetermined engine temperature threshold of each engine; and command each locomotive controller to achieve the desired power level.

18. The consist of claim 17, wherein the power conditions associated with the engine comprise a fueling rate and the central controller is configured to command each locomotive controller to control the cooling system such that the desired power level for each engine is achieved without exceeding the predetermined engine temperature limit.

19. The consist of claim 18, wherein the central controller uses a predefined model to determine the desired power levels for each engine in the consist to control the total train power of the consist.

20. The consist of claim 18, wherein the central controller commands each locomotive controller to adjust the fueling rate of the respective engine such that the engine temperature does not exceed the predetermined engine temperature threshold.

21. The consist of claim 14, wherein the central controller comprises the locomotive controller associated with one of the engines.

* * * * *